US011128110B2

(12) United States Patent
Yamamoto et al.

(10) Patent No.: US 11,128,110 B2
(45) Date of Patent: Sep. 21, 2021

(54) METHODS AND APPARATUS FOR AN IGNITION SYSTEM

(71) Applicant: SEMICONDUCTOR COMPONENTS INDUSTRIES, LLC, Phoenix, AZ (US)

(72) Inventors: Yasunori Yamamoto, Ora-gun (JP); Mikio Yamagishi, Fukaya (JP); Yoshitaka Matsumoto, Ora-gun (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 874 days.

(21) Appl. No.: 15/844,802

(22) Filed: Dec. 18, 2017

(65) Prior Publication Data

US 2019/0190238 A1 Jun. 20, 2019

(51) Int. Cl.

| | |
|---|---|
| ***H01T 15/00*** | (2006.01) |
| ***H01F 38/12*** | (2006.01) |
| ***F02P 3/055*** | (2006.01) |
| *F02P 9/00* | (2006.01) |

(52) U.S. Cl.

CPC ..... *H01T 15/00* (2013.01); *F02P 3/055* (2013.01); *F02P 3/0552* (2013.01); *H01F 38/12* (2013.01); *F02P 9/005* (2013.01)

(58) Field of Classification Search

CPC .... F02D 41/009; F02D 41/0097; F02P 15/10; F02P 3/0456; F02P 3/053; F02P 3/055; F02P 3/0552; F02P 5/15; F02P 5/1502; F02P 7/0775; F02P 9/005; H01F 38/12; H01T 15/00; Y02T 10/46

USPC ..... 123/649, 650, 651, 652; 361/263

See application file for complete search history.

(56) References Cited

U.S. PATENT DOCUMENTS

| | | | | | |
|---|---|---|---|---|---|
| 4,018,202 | A | | 4/1977 | Gartner | |
| 4,068,643 | A | * | 1/1978 | McKechnie | F02P 5/155 123/604 |
| 4,099,507 | A | * | 7/1978 | Pagel | F02D 41/365 123/406.6 |
| 4,112,890 | A | * | 9/1978 | Manger | F02P 15/10 123/406.59 |
| 4,174,696 | A | * | 11/1979 | Jundt | F02P 15/10 123/644 |
| 4,198,936 | A | * | 4/1980 | Pagel | F02P 3/0456 123/609 |
| 4,231,332 | A | | 11/1980 | Wrathall | |
| 4,253,443 | A | * | 3/1981 | Seeger | F02P 7/0672 123/609 |

(Continued)

*Primary Examiner* — Jared Fureman
*Assistant Examiner* — Nicolas Bellido
(74) *Attorney, Agent, or Firm* — Noblitt & Newson, PLLC; Gary W. Newson

(57) ABSTRACT

Various embodiments of the present technology comprise a method and apparatus for an ignition system. In various embodiments, the ignition system activates a soft shutdown of an ignition coil in the event of an over dwell condition. The apparatus comprises a first counter and a second counter that are selectively activated at predetermined events. An output of the second counter controls the value of a reference current that decreases linearly over time and wherein a rate of change of the reference current may be adjusted according to a frequency of a clock signal. In various embodiments, the soft shutdown operates independent of the supply voltage and temperature.

19 Claims, 8 Drawing Sheets

(56) References Cited

U.S. PATENT DOCUMENTS

| | | | | | |
|---|---|---|---|---|---|
| 4,267,810 | A | * | 5/1981 | Wesemeyer | G01P 3/4815 123/406.61 |
| 4,329,959 | A | | 5/1982 | Javeri | |
| 4,359,036 | A | * | 11/1982 | Seeger | F02P 7/0672 123/609 |
| 4,366,800 | A | * | 1/1983 | Seeger | F02P 3/0456 123/609 |
| 4,378,769 | A | * | 4/1983 | Haubner | F02P 9/005 123/335 |
| 4,467,776 | A | * | 8/1984 | Mezger | F02P 5/15 123/609 |
| 4,538,585 | A | | 9/1985 | Arguello | |
| 4,774,925 | A | * | 10/1988 | Iwata | F02P 3/0554 123/632 |
| 4,836,175 | A | * | 6/1989 | Hansen | F02P 3/0456 123/609 |
| 4,848,304 | A | * | 7/1989 | Iwata | F02P 3/0456 123/609 |
| 5,664,550 | A | * | 9/1997 | Ito | F02P 3/051 123/630 |
| 7,095,182 | B2 | * | 8/2006 | Ando | F02P 3/051 123/630 |
| 10,103,623 | B2 | * | 10/2018 | Kohama | H02M 3/156 |
| 2004/0200463 | A1 | * | 10/2004 | Ando | F02P 11/06 123/630 |
| 2005/0046278 | A1 | | 3/2005 | Long | |
| 2005/0104630 | A1 | | 5/2005 | Kesler | |
| 2005/0178372 | A1 | | 8/2005 | Kesler | |
| 2011/0134581 | A1 | | 6/2011 | Godo | |
| 2011/0141651 | A1 | | 6/2011 | Godo | |

* cited by examiner

SIGNAL INPUT
[V]
0
TIME

IGBT GATE VOLTAGE ($V_{GATE}$)
[V]
0
TIME

FIRST COUNTER
COUNT NUMBER
0
TIME

SECOND COUNTER
COUNT NUMBER
0
COUNTER PAUSE
TIME

CURRENT
[A]
$I_{SAT}$
0
REFERENCE CURRENT ($I_{REF}$)
COIL CURRENT
$T_{SSD}$
$T_{ON}$

SIGNAL INPUT
IGBT GATE VOLTAGE (VGATE)
FIRST RAMP GENERATOR
SECOND RAMP GENERATOR
CURRENT
[V]
[A]
0
TIME
TH2
TH1
ISAT
PAUSED
TON
TSSD
REFERENCE CURRENT (IREF)
COIL CURRENT

METHODS AND APPARATUS FOR AN IGNITION SYSTEM

BACKGROUND OF THE TECHNOLOGY

An ignition coil typically used in ignition systems may be electrically controlled. Specifically, an electronic control unit (ECU) generally controls the dwell time of the ignition coil. The dwell time is the period of time that the coil is turned ON and is usually predetermined based on the system application. In some cases, however, malfunctions of the ECU may result in the ignition coil being turned on longer than it should (this condition may be referred to as "over dwell"), which may cause damage (e.g., melting and/or burning) to the ignition coil. In such a case, many conventional systems have a timeout function which activates a shutdown operation. In the shutdown operation, the coil current is turned off in either a manner of a "hard shutdown" or a "soft shutdown". The "hard shutdown" quickly turns off the coil current through the ignition coil regardless of the crank position if the ignition coil operation time goes into over dwell. The "soft shutdown" slowly reduces the current through the ignition coil if the ignition coil operation time goes into over dwell. In cases where the ignition coil current is limited only by the resistance of the coil, and not an intentionally limited current, a time-lag exists between the intended start time of the soft shutdown period and the actual start time of the soft shutdown period. This time-lag effectively increases the length of time that the ignition coil is ON and is a function of the supply voltage. For example, the time-lag is greater in cases where the supply voltage is relatively low, which increases the likelihood that the ignition coil will be damaged due to overheating.

SUMMARY OF THE INVENTION

Various embodiments of the present technology comprise a method and apparatus for an ignition system. In various embodiments, the ignition system activates a soft shutdown of an ignition coil in the event of an over dwell condition. The apparatus comprises a first counter and a second counter that are selectively activated at predetermined events. An output of the second counter controls the value of a reference current that decreases linearly over time and wherein a rate of change of the reference current may be adjusted according to a frequency of a clock signal. In various embodiments, the soft shutdown operates independent of the supply voltage and temperature.

BRIEF DESCRIPTION OF THE DRAWING FIGURES

A more complete understanding of the present technology may be derived by referring to the detailed description when considered in connection with the following illustrative figures. In the following figures, like reference numbers refer to similar elements and steps throughout the figures.

FIG. 1 representatively illustrates an ignition system in accordance with an exemplary embodiment of the present technology;

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various current limiters, digital-to-analog converters, ignition coils, switching circuits, counters, current sensors, and the like, which may carry out a variety of functions. In addition, the present technology may be practiced in conjunction with any number of systems, such as automotive, marine, and aerospace, and the systems described are merely exemplary applications for the technology. Further, the present technology may employ any number of conventional techniques for providing a control signal, sensing a current, signal conversion, generating a clock signal, and the like.

Figure 1:
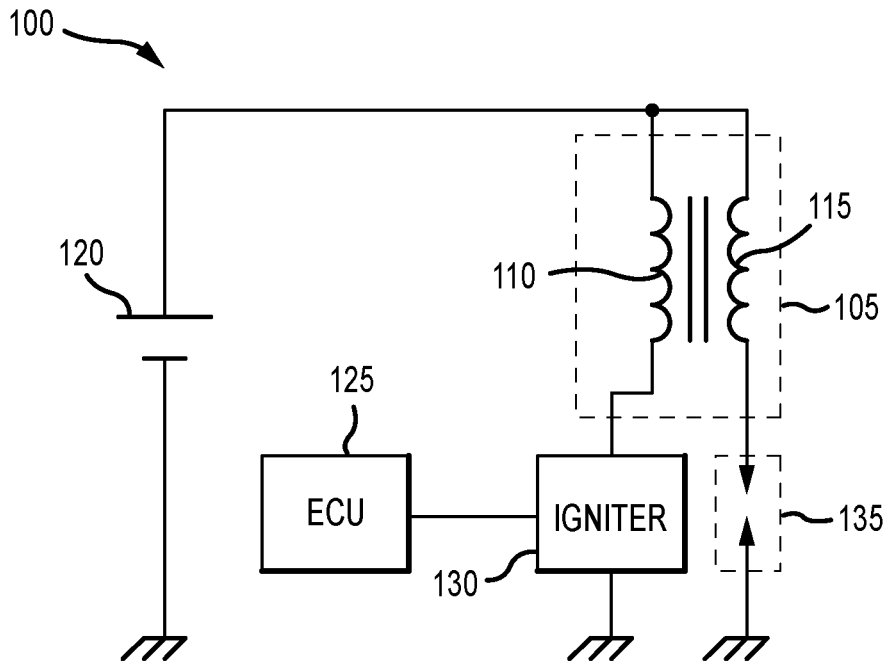

Methods and apparatus for an ignition system according to various aspects of the present technology may operate in conjunction with any suitable automotive system, such as an automobile with an internal combustion engine, and the like. Referring to FIG. 1, an exemplary ignition system 100 may be incorporated into an automotive system powered by an internal combustion engine. For example, in various embodiments, the ignition system 100 may comprise an electronic control unit (ECU) 125, an igniter circuit 130, an ignition coil 105, a power source 120, and a spark plug 135 that operate together to generate a very high voltage and create a spark that ignites the fuel-air mixture in the engine's combustion chambers.

The power source 120 acts as a power supply to the ignition system 100. For example, the power source 120 may generate a DC (direct current) supply voltage $V_{DD}$. The power source 120 may comprise any suitable device and/or system for generating power. For example, the power source 120 may comprise a 12-volt lead-acid battery commonly used in automotive applications. In an exemplary embodiment, the power source 120 may be coupled to the ignition coil 105. In various embodiments, the power source 120 may also be coupled to other components, such as the ECU 125, to facilitate operation.

The ECU 125 may control various operations of one or more components in the ignition system 100. For example, the ECU 125 may be configured to transmit various control signals representing an ON/OFF mode, a particular operating state, and the like. In an exemplary embodiment, the ECU 125 may be coupled to the igniter 130 and configured to transmit an ECU signal to operate the igniter 130. For example, the ECU signal may represent the ON/OFF mode of the igniter 130, which in turn controls operation of the ignition coil 105. In the event of a failure or malfunction of the ECU 125, the igniter 130 and ignition coil 105 may operate in an unintended manner and create an over dwell situation.

In general, the ECU 125 may be programmed with a predetermined dwell time, which is the preferred amount of time that the ignition coil 130 should be in the ON mode to achieve normal operation. The dwell time may be selected according to the particular application, the rated size of the power source 120, and/or transformation capabilities of the ignition coil 105. In a case where the ECU 125 does not turn off the igniter 130 at the desired time, the igniter 130 and ignition coil 105 will continue to operate in the ON mode. Most ignition systems 100, however, have a built-in function to turn off the ignition coil 105 if the igniter 130 remains in the ON mode longer than expected.

The ignition coil 105 transforms the DC voltage of the power source 120 to a higher voltage needed to create an electric spark in the spark plug 135, which in turn ignites the fuel-air mixture fed to the engine. For example, the ignition coil 105 may be electrically coupled to a positive terminal of the power source 120 and the spark plug 135. The ignition system 100 may comprise any suitable coil, for example, an induction coil. In various embodiments, the ignition coil 105 may comprise a primary coil 110 with a primary voltage $V_{C1}$ and a secondary coil 115 with a secondary voltage $V_{C2}$. In an exemplary embodiment, the primary coil 110 comprises a wire with relatively few turns and the secondary coil 115 comprises a wire thinner than that used in the primary coil 110 with many more turns. The ignition coil 105 may be described according to a turn ratio (N=N2/N1), which is the number of turns of the secondary coil 115 (N2) to the number of turns of the primary coil 110 (N1). In general, the secondary voltage $V_{C2}$ is equal to the primary voltage $V_{C1}$ multiplied by the turn ratio (i.e., $V_{C2}=V_{C1}\times N$). Accordingly, the secondary voltage $V_{C2}$ is higher than the primary voltage $V_{C1}$. In an exemplary embodiment, the primary coil 110 may be coupled to the igniter 130 and the secondary coil 115 may be coupled to the spark plug 135.

Figure 2:
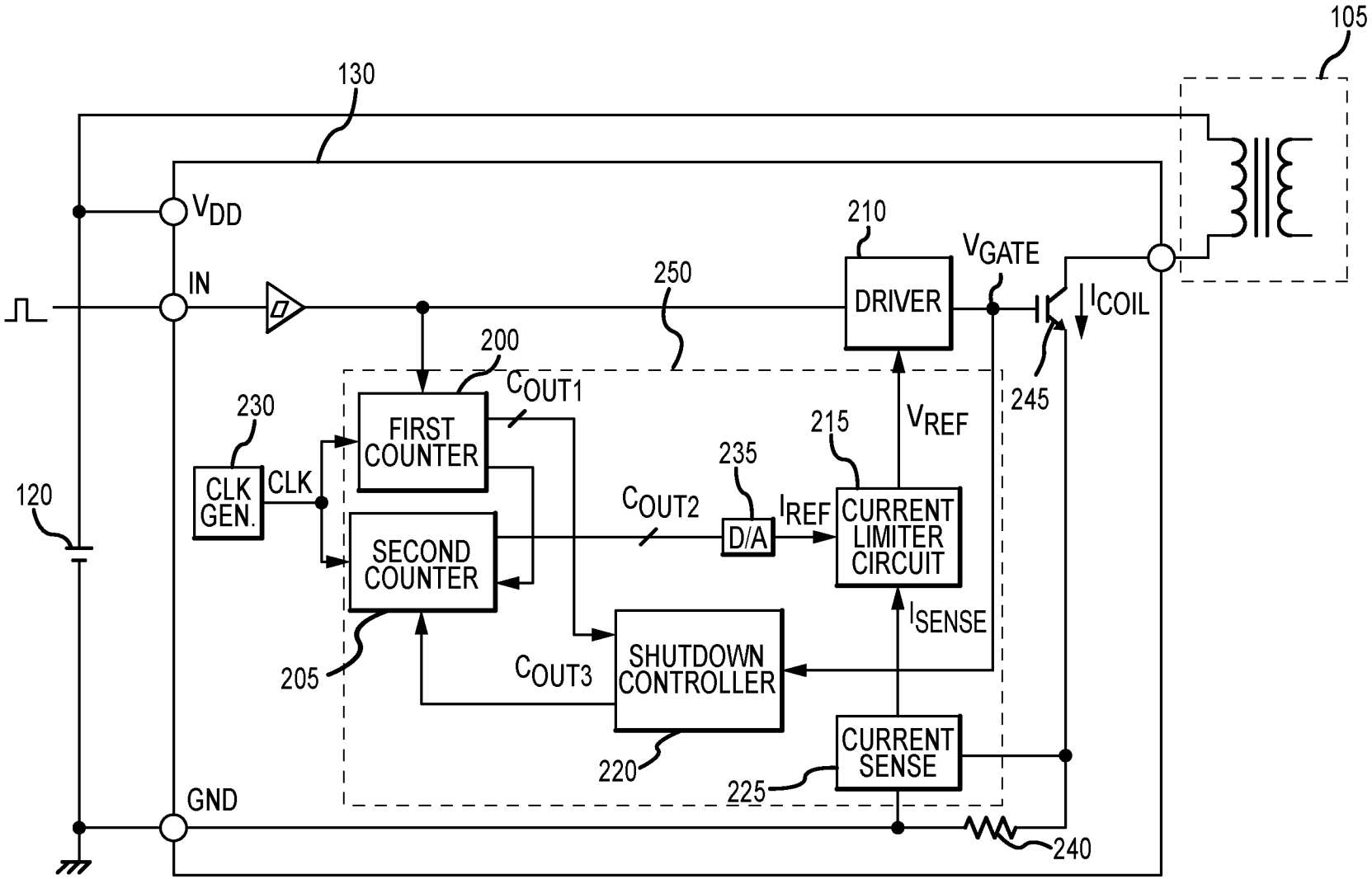
FIG. 2 is a block diagram of an igniter circuit in accordance with an exemplary embodiment of the present technology.
Figure 3:
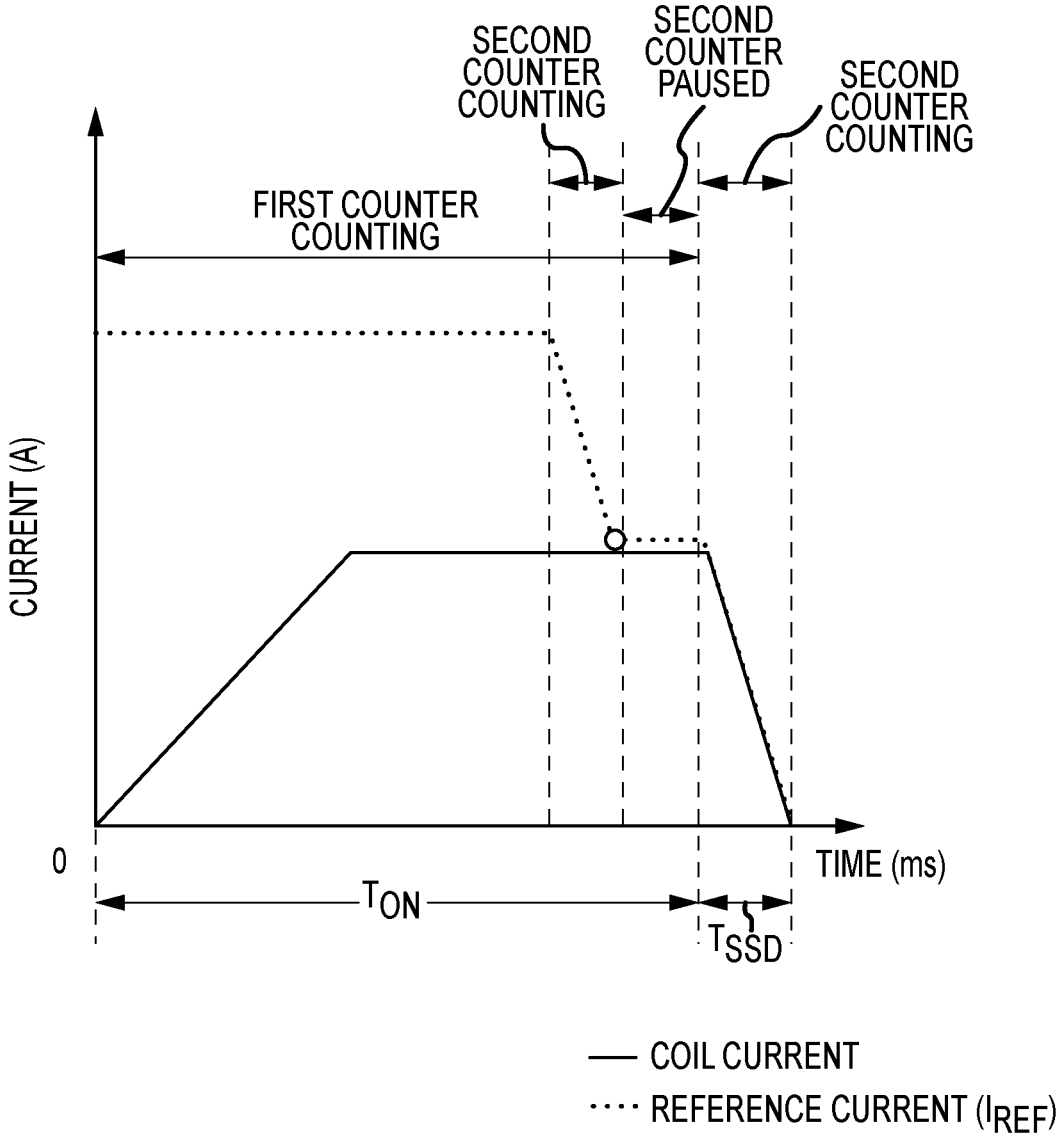
FIG. 3 is a graph illustrating a current of an ignition coil in accordance with an exemplary embodiment of the present technology.
Figures 4A, 4B, 4C, 4D, 4E:
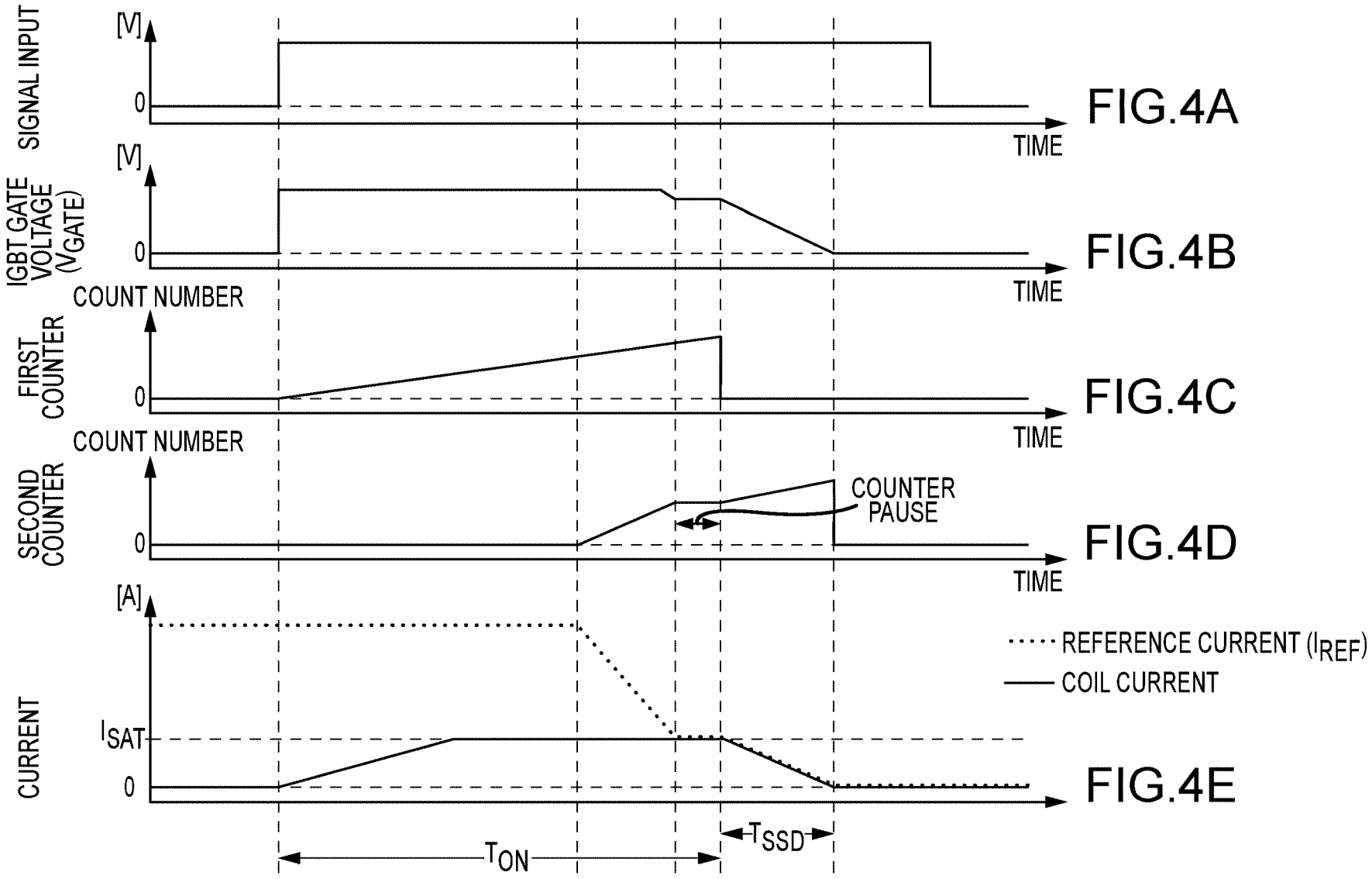
FIG. 4A is a graph illustrating an electronic control unit signal in accordance with an exemplary embodiment of the present technology.
FIG. 4B is a graph illustrating an IGBT gate voltage in accordance with an exemplary embodiment of the present technology.
FIG. 4C is a graph illustrating a count output of a first counter in accordance with an exemplary embodiment of the present technology.
FIG. 4D is a graph illustrating a count output of a second counter in accordance with an exemplary embodiment of the present technology.
FIG. 4E is a graph illustrating a coil current and corresponding reference current in accordance with an exemplary embodiment of the present technology.

According to various embodiments, the igniter 130 controls and/or measures (or detect or sense) a coil current $I_{COIL}$ through ignition coil 105. In an exemplary embodiment, the igniter 130 may also be configured to perform a soft shutdown operation to turn off the ignition coil 105 if a malfunction or operational error has occurred and dwell time exceeded a predetermined timeout period. In an exemplary embodiment, the igniter 130 may be coupled to the primary coil 110 and the coil current $I_{COIL}$ may be a current through the primary coil 110. The igniter 130 may comprise various circuit devices and/or systems for providing a count value, current sensing, signal amplification, controlling a reference voltage, signal conversion, controlling and/or limiting a current, and the like. For example, and referring to FIG. 2, the igniter 130 may comprise a switch element 245, a protection circuit 250, and a driver circuit 210. The igniter 130 may further comprise a clock generator circuit 230 configured to generate a clock signal CLK with a fixed or variable frequency.

According to various embodiments, the igniter 130 may further comprise a current source (not shown) configured to provide a bias current to the current limiter circuit 215, current sensor circuit 225, and/or other circuits within the igniter 130. The current source may comprise any suitable circuit and/or system configured to generate a predetermined current.

The protection circuit 250 operates in conjunction with the switch element 245 to gradually reduce a current through the primary coil 110 (i.e., a coil current $I_{COIL}$) until the ignition coil 105 is fully shutdown (i.e., the coil current equals zero) and no longer providing a voltage to the spark plug 135. The protection circuit 250 may be configured to convert a voltage to a current, provide a difference current of multiple currents, amplify a signal, and/or facilitate limiting and/or stopping the coil current $I_{COIL}$. For example, the protection circuit 250 may comprise a first counter 200, a second counter 205, a shutdown controller 220, a current limiter circuit 215, and a current sense circuit 225. The protection circuit 250 may further comprise a signal converter, such as a digital-to-analog (D/A) converter 235. The protection circuit 250 may operate in conjunction with the switch element 245 to generate a desired coil current $I_{COIL}$ during the soft shutdown operation. The particular magnitude of the coil current $I_{COIL}$ during the soft shutdown may be selected according to the rated size of the power source 120, the particular application, and/or transformation capabilities of the ignition coil 105.

The first and second counters 200, 205 may be configured to generate a digital output that incrementally increases/decreases. The first and second counters 200, 205 may be coupled to the clock generator circuit 230 to receive the clock signal CLK. For example, the first counter 200 may generate a first count output $C_{OUT1}$ according to the clock signal CLK, and similarly, the second counter 205 may generate a second count output $C_{OUT2}$ according to the clock signal CLK. The first and second counters 200, 205 may comprise any circuit and/or device suitable for generating a predefined state based on a clock pulse, such as a circuit constructed of flip-flops. In an exemplary embodiment, the first and second count outputs $C_{OUT1}$, $C_{OUT2}$ are digital signals. In alternative embodiments, the first and second count outputs $C_{OUT1}$, $C_{OUT2}$ may be any signal suitable for indicating a count value.

In an exemplary embodiment, a first output terminal of the first counter 200 may be coupled to the shutdown controller 220 and/or the second counter 205. Alternatively, a second output terminal of the first counter 200 may be coupled to the second counter 205 and configured to transmit a flag signal to the second counter 205 to start/stop operation of the second counter 205. In an exemplary embodiment, the second counter 205 may be responsive to the first count output $C_{OUT1}$ and/or the flag signal transmitted from the first counter 200. An output terminal of the second counter 205 may be coupled to the digital-to-analog converter 235, wherein the digital-to-analog converter 235 converts the second count output to a reference current $I_{REF}$. The digital-to-analog converter 235 may then transmit the reference current $I_{REF}$ to the current limiter circuit 215.

In an exemplary embodiment, the first counter 200 may be programmed to count for a predetermined number of counts and/or a predetermined period of time, such as for 256 counts, 512 counts, or 1024 counts. The number of counts may be based on the particular specifications and/or desired shutdown operation of the ignition system 100 (FIG. 1). Since the first and second count outputs $C_{OUT1}$, $C_{OUT2}$ are based on the clock signal CLK, the frequency of the clock signal CLK will dictate the number of counts over a given period of time. The predetermined number of counts and/or period of time may be selected according to the particular application, the ignition coil specifications, the maximum supply voltage of the power source 120, and other relevant parameters.

The shutdown controller 220 may be configured to control the operation of various circuits within the igniter 130. For example, the shutdown controller 220 may be coupled to the second counter 205 and may generate a controller output signal $C_{OUT3}$ to stop/start operation of the second counter 205. In an exemplary embodiment, the shutdown controller 220 may be coupled to the gate terminal of the switch element 245 and configured to detect a gate voltage $V_{GATE}$ of the switch element 245. The shutdown controller 220 may further be configured to detect a change in the gate voltage $V_{GATE}$, such as a decrease in the gate voltage $V_{GATE}$. In general, when the gate voltage $V_{GATE}$ starts to decrease, this indicates that the coil current $I_{COIL}$ is about to start decreasing as well. In an exemplary embodiment, the shutdown controller 220 transmits the controller output signal $C_{OUT3}$ to stop the second counter 205 when the first counter output $C_{OUT1}$ reaches a predetermined value and/or to resume operation of the second counter 205 when the shutdown controller 220 detects a decrease in the gate voltage $V_{GATE}$. The shutdown controller 220 may comprise any circuit and/or system configured to process data and transmit data according to predetermined events. For example, the shutdown controller 220 may comprise various logic circuits, a memory, an operational amplifier, and the like. The shutdown controller 220 may also be electrically connected to and receive power from the power source 120.

The current limiter circuit 215 is configured to control operation of the switch element 245. For example, an output terminal of the current limiter circuit 215 may be directly coupled to an input of the switch element 245 or may be coupled to the input of the switch element via the driver circuit 210. The current limiter circuit 215 may also be configured to compare and/or amplify a signal. For example, the current limiter circuit 215 may comprise an operational amplifier or any other suitable amplifier with variable gain. The current limiter circuit 215 may generate a reference voltage $V_{REF}$ at the output terminal according to the reference $I_{REF}$ and a sensed current $I_{SENSE}$, where the sensed current $I_{SENSE}$ is generated according to the coil current $I_{COIL}$, which in turn controls the gate voltage $V_{GATE}$. For example, the current limiter circuit 215 may compare the reference current $I_{REF}$ to the sensed current $I_{SENSE}$. The current limiter circuit 215 may maintain the level of the reference voltage $V_{REF}$, and in turn, the gate voltage $V_{GATE}$, until the reference current $I_{REF}$ reaches a particular value, in which case the current limiter circuit 215 may start to decrease the reference voltage $V_{REF}$, which in turn also decreases the gate voltage $V_{GATE}$. In an exemplary embodiment, the output terminal is coupled to the switch element 245, wherein the switch element 245 is responsive to the gate voltage $V_{GATE}$. The current limiter circuit 215 may comprise any suitable circuit for amplifying and/or attenuating an input signal and/or comparing two signals. In an exemplary embodiment, the current limiter circuit 215 may further be coupled to a current sense circuit 225 that senses/detects the coil current $I_{COIL}$.

The current sense circuit 225 senses and/or detects a current. In an exemplary embodiment, the current sense circuit 225 operates in conjunction with a sense resistor 240 to detect the magnitude of the coil current $I_{COIL}$. For example, the current sense circuit 225 may be connected at a first point between a terminal of the switch element 245 and the sense resistor 225, and at a second point between the sense resistor 240 and a ground GND. The current sense circuit 225 may be configured to sense the coil current $I_{COIL}$ by indirectly sensing a voltage across the sense resistor 240. The current sense circuit 225 may convert the sensed voltage to the sensed current $I_{SENSE}$ value which corresponds to coil current $I_{COIL}$. The current sense circuit 225 may comprise any circuit and/or system suitable for sensing and/or measuring a current, either directly or indirectly.

The current limiter circuit 215 may be responsive to the magnitude of the sensed current $I_{SENSE}$. For example, the current limiter circuit 215 may utilize information related to the coil current $I_{COIL}$ and/or the sensed current $I_{SENSE}$ to adjust its output signal. For example, the current limiter circuit 215 may increase or decrease the magnitude of the reference voltage $V_{REF}$ according to a comparison between the sensed current $I_{SENSE}$ and the reference current $I_{REF}$.

The switch element 245 is configured to control operation of the ignition coil 105. For example, in an exemplary embodiment, the switch element 245 is coupled to the primary coil 110 and controls the coil current $I_{COIL}$. The switch element 245 may comprise any circuit and/or system suitable capable of controlling a current flow.

In an exemplary embodiment, the switch element 245 comprises an insulated-gate bipolar transistor (IGBT) having a gate terminal, an emitter terminal, and a collector terminal. In the present embodiment, the collector terminal is coupled to the primary coil 110, the emitter terminal is coupled to the sense resistor 240 and current sense circuit 225, and the gate terminal is coupled to an output of the current limiter circuit 215 and/or the driver circuit 210. Accordingly, the switch element 245 is responsive to the current limiter circuit 215 and/or the driver circuit 210, and as a voltage to the gate terminal (i.e., the gate voltage $V_{GATE}$) increases, the coil current $I_{COIL}$ also increases.

Figure 7:
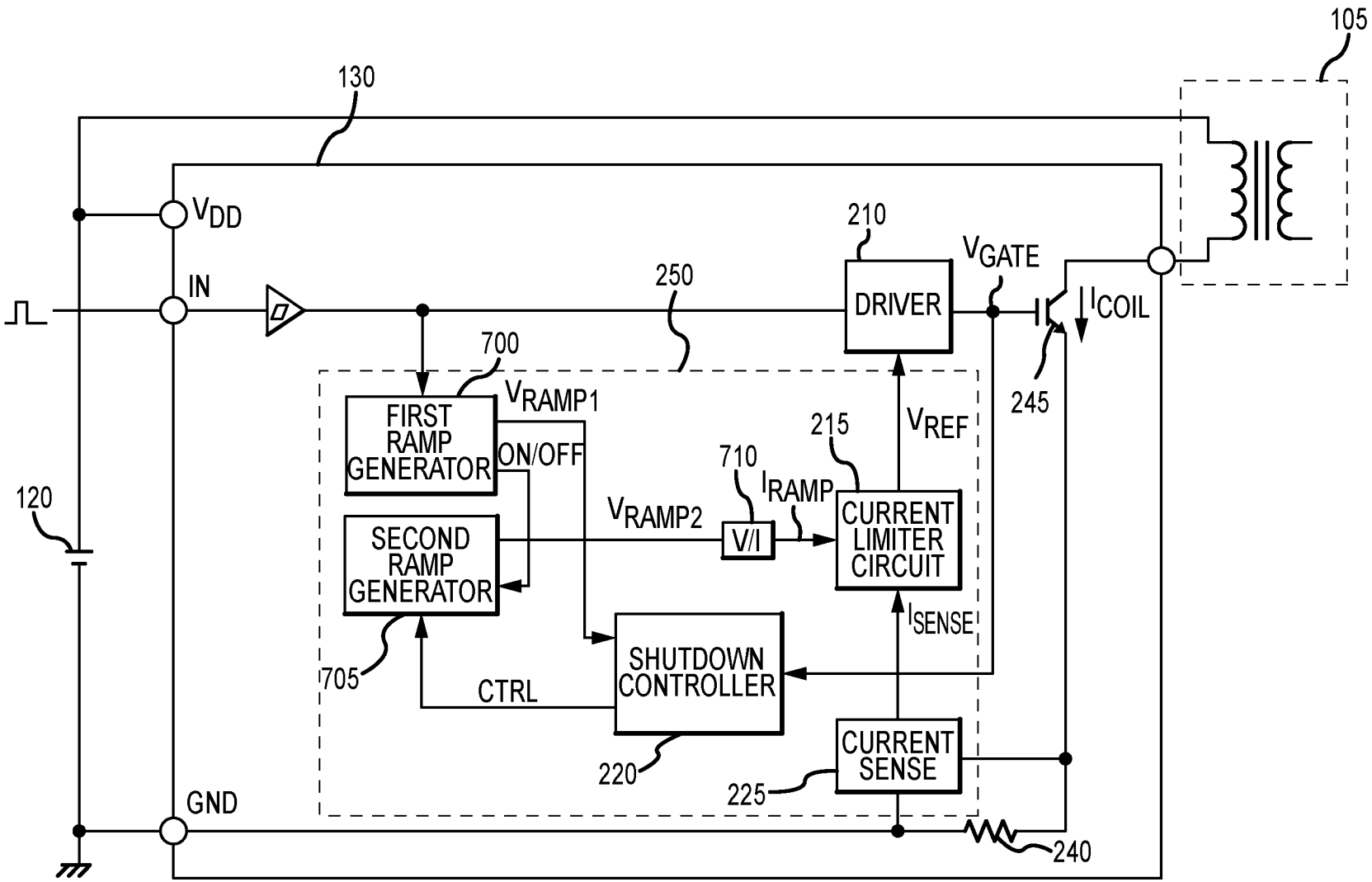
FIG. 7 is a block diagram of an igniter circuit in accordance with an alternative embodiment of the present technology.
Figures 8A, 8B, 8C, 8D, 8E:
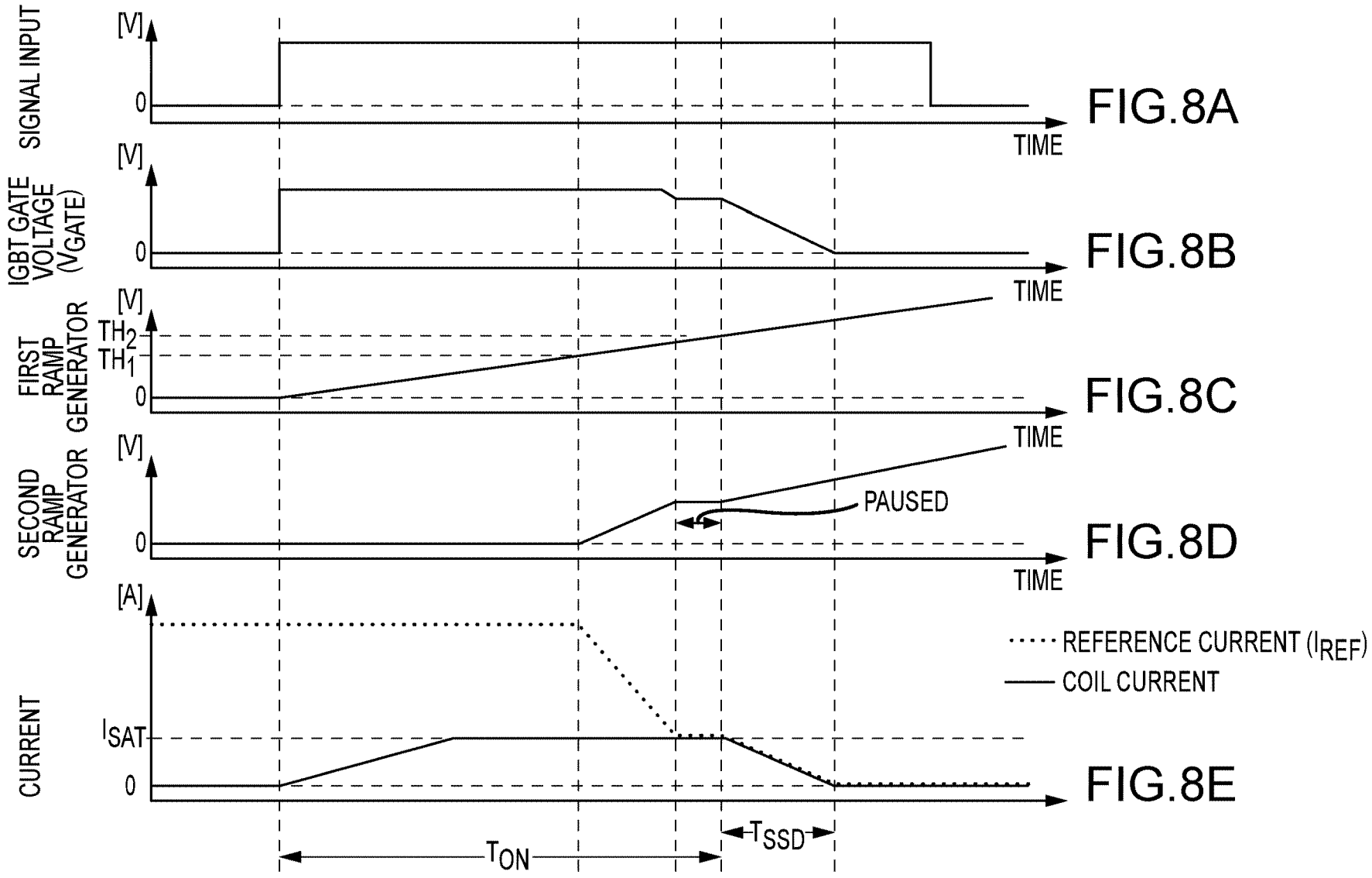
FIGS. 8A-8E are waveform outputs in accordance with the igniter circuit of FIG. 7.

In an alternative embodiment, the protection circuit 250 may be implemented using analog technology. For example, and referring to FIG. 7, the protection circuit 250 may comprise a first ramp generator 700 (equivalent to the first counter 200, FIG. 2) to generate a first ramp voltage $V_{RAMP1}$, a second ramp generator 705 (equivalent to the second counter 205, FIG. 2) to generate a second ramp voltage $V_{RAMP2}$, and a voltage-to-current converter 710 (equivalent to the D/A converter 235, FIG. 2). In the present embodiment, the shutdown controller 220 is responsive to the first ramp voltage $V_{RAMP1}$ and transmits a control signal CTRL to the second ramp generator 705. The first ramp generator 700 may also be coupled to the second ramp generator 705 and may be configured to transmit an ON/OFF signal to start/stop the second ramp generator 705. The ON/OFF signal may correspond to particular values of the first ramp voltage $V_{RAMP1}$. The second ramp generator 705 may transmit the second ramp voltage $V_{RAMP2}$ to the voltage-to-current converter 710 where the voltage-to-current converter 710 converts the second ramp voltage $V_{RAMP2}$ to a ramp current $I_{RAMP}$. The current limiter circuit 215 responds to the ramp current $I_{RAMP}$ in the same manner as described above.

In various alternative embodiments, the protection circuit 250 may be implemented with a combination of both digital and analog devices. For example, in one embodiment, the protection circuit 250 may comprise the first counter 200, the second ramp generator 705, and the voltage-to-current converter 710. In an alternative embodiment, the protection circuit 250 may comprise the first ramp generator 700, the second counter 205, and the D/A converter 235.

According to various embodiments, the igniter 130 operates to provide quick and stable activation of the shutdown function, as well as to ensure that a total time that the ignition coil is ON is not extended due to the level of the supply voltage. In operation, the igniter 130 activates the soft shutdown operation of the ignition coil 105 in a case of a malfunction, such as a malfunction of the ECU 125, which results in current flowing through the ignition coil 105 for an extended, or otherwise unintended period of time. To prevent damage to the ignition coil 105 and ensure that a soft shutdown period $T_{SSD}$ starts as soon as reasonably possible to reduce a total amount of time that the ignition coil 105 is ON (e.g., $T_{ON}$), and ends as quickly as possible, but long enough to reduce an inductive kickback that may occur during the soft shutdown period $T_{SSD}$. Extending the soft shutdown period may help prevent an unintentional spark of the spark plug 135.

Referring to FIGS. 2, 3, and 4A-4E, in an exemplary operation, the ECU applies a high ECU signal input to the igniter 130. This high signal increases the gate voltage $V_{GATE}$ of the switch element 245, which allows the current through the ignition coil 105 to increase. As soon as the ECU applies the high ECU signal input, the first counter 200 starts counting and transmitting the first count output $C_{OUT1}$ to the shutdown controller 220. The first counter 200 counts for a first predetermined period of time $T_{ON}$. After the first counter 200 has counted up to a particular count value and/or a particular time value (e.g., a count of 1024 or 30 ms), the first counter 200 transmits a first flag signal to the second counter 205 to initiate operation of the second counter 205. In other words, the second counter 205 starts to generate the second count output $C_{OUT2}$ at a predetermined instance during the first predetermined period $T_{ON}$. In an alternative embodiment, the shutdown controller 220 may initiate operation of the second counter 205 via the controller output signal $C_{OUT3}$ upon receipt of the particular count value and/or the particular time value. The particular count value and/or the time value is set to be less than the first predetermined period of time $T_{ON}$. The second counter 205 then counts and transmits the second count output $C_{OUT2}$ to the digital-to-analog converter 235. The digital-to-analog converter then converts the second count output $C_{OUT2}$ to the reference current $I_{REF}$. In an exemplary embodiment, the reference current $I_{REF}$ is initially set to be greater than a saturation current $I_{SAT}$ (FIG. 4E) of the switch element 245. In other words, an initial second count output $C_{OUT2}$ corresponds to a reference current $I_{REF}$ value that is greater than the saturation current $I_{SAT}$ of the switch element 245. In an exemplary embodiment, the reference current $I_{REF}$ decreases as the second count output $C_{OUT2}$ increases.

The second counter 205 continues to count until the shutdown controller 220 detects a decrease in the gate voltage $V_{GATE}$. When this occurs, the shutdown controller 220 transmits the controller output signal $C_{OUT3}$ to the second counter 205 to pause the second counter 205. When the first counter 200 reaches the end of the first predetermined period $T_{ON}$, the first counter 200 may transmit a second flag signal to the second counter 205 to resume operation of the second counter 205 and shutdown period $T_{SSD}$ starts.

The switch element 245 controls the coil current $I_{COIL}$ and is responsive to the gate voltage $V_{GATE}$. Accordingly, as the reference voltage $V_{REF}$ decreases, the gate voltage $V_{GATE}$ decreases, and the coil current $I_{COIL}$ also decreases. Therefore, during the soft shutdown period $T_{SSD}$, the second counter output $C_{OUT2}$ increases, the reference current $I_{REF}$ decreases, and the reference voltage decreases, which decreases the coil current $I_{COIL}$. The second counter 205 continues to count until the coil current $I_{COIL}$ reaches zero.

In an exemplary embodiment, the igniter 130 controls the coil current $I_{COIL}$ such that during the soft shutdown period $T_{SSD}$, the coil current $I_{COIL}$ decreases in a linear manner. In other embodiments, however, the coil current $I_{COIL}$ may first decrease in a non-linear manner and then continue to decrease in a linear manner. A rate of change of the coil current $I_{COIL}$ may be adjusted according to the frequency of the clock signal CLK.

Figure 5:
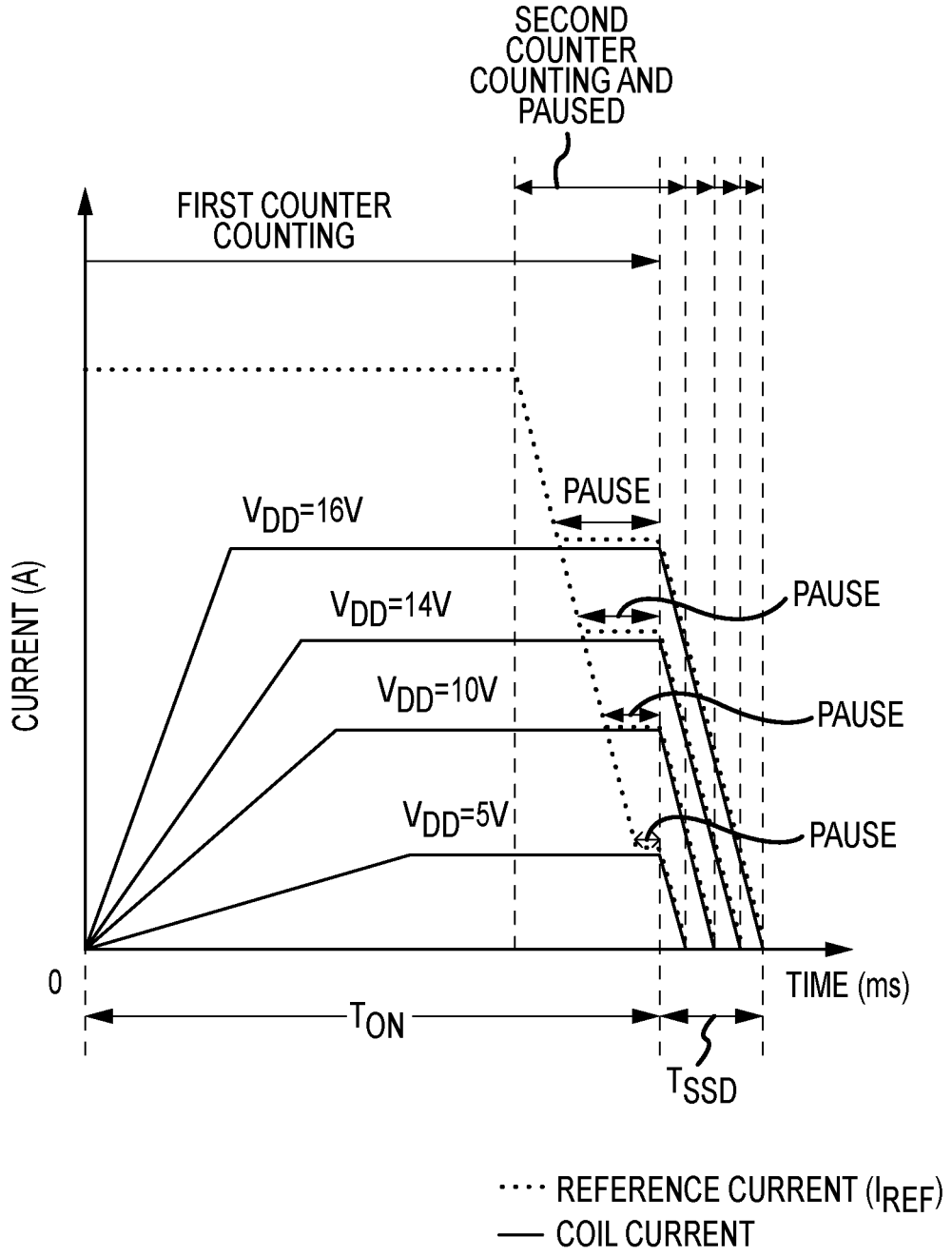
FIG. 5 is a graph illustrating a coil current at various supply voltage levels in accordance with a first operation of the present technology.
Figure 6:
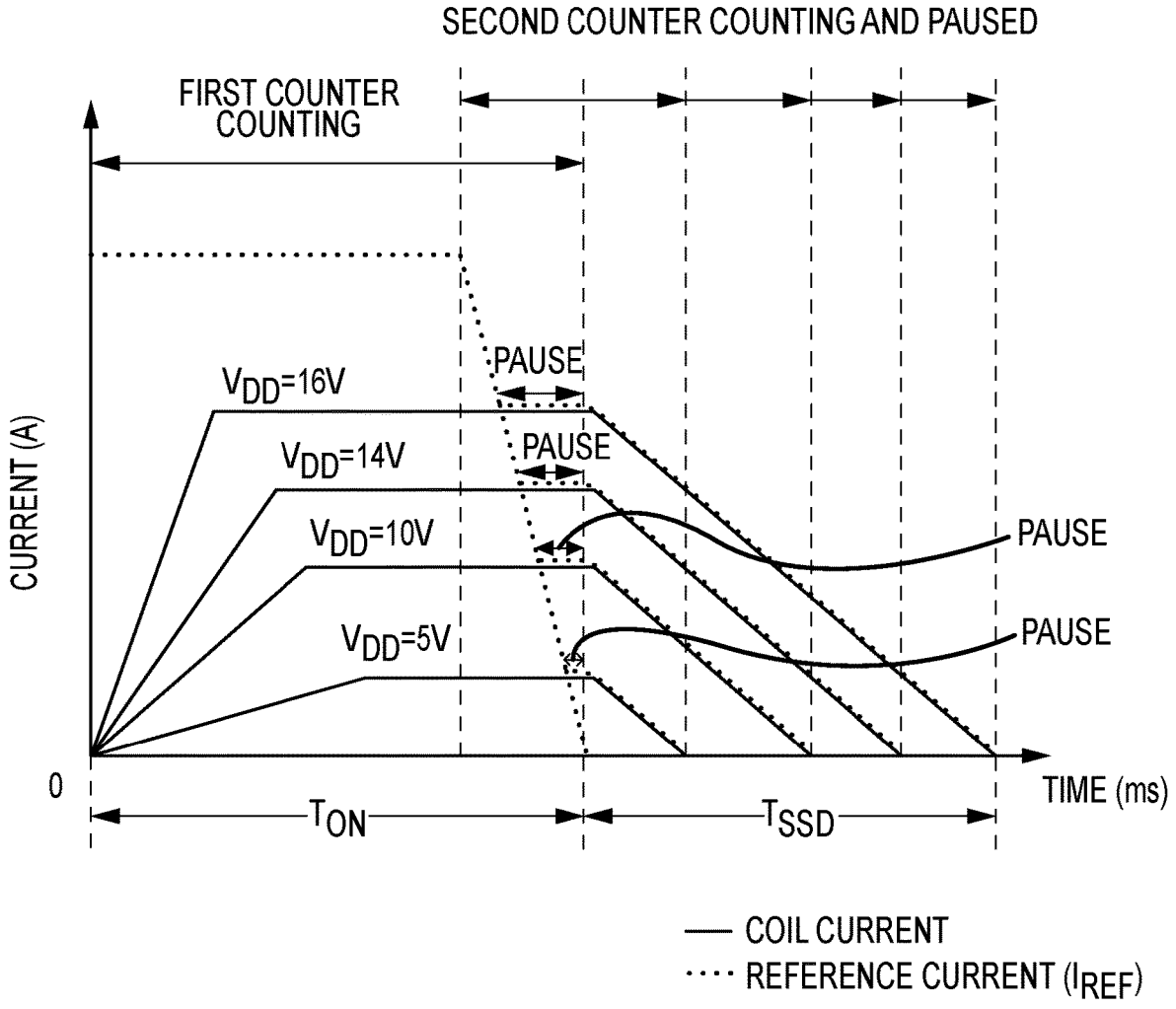
FIG. 6 is a graph illustrating a coil current at various supply voltage levels in accordance with a second operation of the present technology.

Referring to FIGS. 5, and 6, according to various operating specifications, the period during which the second counter 205 is paused, is a function of the supply voltage $V_{DD}$. Further, the soft shutdown period $T_{SSD}$ is a function of the frequency of the clock signal CLK. In other words, a rate of change of the second count output $C_{OUT2}$, the reference voltage $V_{REF}$, reference current $I_{REF}$ and/or the coil current $I_{COIL}$ is based on the frequency of the clock signal CLK, such that as the frequency increases, the rate of change in the coil current $I_{COIL}$ increases, and vise versa. Accordingly, the soft shutdown period $T_{SSD}$ may be shortened or lengthened by varying the frequency of the clock signal CLK.

It may also be noted that the period in which the ignition coil 105 is ON (i.e., the first predetermined period $T_{ON}$) is independent of the supply voltage $V_{DD}$ and the temperature of the ignition coil 105 as long as the rate of clock signal CLK is constant. Further, a total second count output is a function of the supply voltage $V_{DD}$. For example, the higher the supply voltage $V_{DD}$, the longer the second counter 205 will count before the coil current $I_{COIL}$ reaches zero. Overall, the operation described above shortens the total time that the ignition coil 105 is ON (i.e., $T_{ON}$) compared to conventional systems where the end of the ON period (and the beginning of the soft shutdown period $T_{SSD}$) is a function of the supply voltage $V_{DD}$.

In an alternative operation, and referring to FIGS. 7 and 8A-8E, the second ramp generator 705 may be activated and start generating the second ramp voltage $V_{RAMP2}$ when the first ramp voltage $V_{RAMP1}$ reaches a first threshold value $TH_1$. After a pause period, the second ramp generator 705 may be reactivated and resume generating the second ramp voltage $V_{RAMP2}$ when the first ramp voltage $V_{RAMP1}$ reaches a second threshold value $TH_2$.

In the foregoing description, the technology has been described with reference to specific exemplary embodiments. The particular implementations shown and described are illustrative of the technology and its best mode and are not intended to otherwise limit the scope of the present technology in any way. Indeed, for the sake of brevity, conventional manufacturing, connection, preparation, and other functional aspects of the method and system may not be described in detail. Furthermore, the connecting lines shown in the various figures are intended to represent exemplary functional relationships and/or steps between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. An igniter circuit configured to operate according to a clock signal and control an ignition coil, comprising:

a first counter responsive to the clock signal and configured to count for a first predetermined period and generate a first count output;

a second counter responsive to the clock signal and configured to count and generate a second count output; wherein the second counter starts counting at a predetermined instance during the first predetermined period;

a switch element comprising:

a first terminal, wherein the first terminal is a gate terminal;

a second terminal coupled to the ignition coil; and a third terminal;

a current limiter circuit comprising:

an input terminal coupled to an output terminal of the second counter; and an output terminal coupled to the first terminal of the switch element;

wherein the current limiter circuit is configured to generate an output based on the second count output; and a shutdown controller comprising:

an output terminal coupled to an input terminal of the second counter and the switch element; and an input terminal coupled to the first terminal of the switch element;

wherein the shutdown controller is configured to detect a change to the current limiter circuit output.

2. The igniter circuit according to claim 1, wherein:

the second terminal of the switch element is a collector terminal;

the third terminal of the switch element is an emitter terminal and is coupled to a current sense circuit; and wherein the switch element:

is responsive to the current limiter circuit output; and has a saturation current responsive to the ignition coil.

3. The igniter circuit according to claim 2, wherein an initial count value of the second counter corresponds to a reference current value that is greater than the saturation current of the switch element.

4. The igniter circuit according to claim 2, wherein the shutdown controller is configured to:

detect a decrease in a gate voltage at the gate terminal of the switch element; and pause the second counter when the decrease is detected.

5. The igniter circuit according to claim 4, wherein the second counter resumes counting at the end of the first predetermined period.

6. The igniter circuit according to claim 1, wherein a total count of the second counter during a soft shutdown period is a function of a supply voltage level.

7. The igniter circuit according to claim 1, wherein the first counter:

starts counting when a control signal is enabled; and ends at a predetermined count value.

8. The igniter circuit according to claim 1, wherein the first predetermined period is independent of both a supply voltage level and a temperature of the ignition coil.

9. The igniter circuit according to claim 1, wherein the first counter and the shutdown controller are configured to selectively operate the second counter according to the first count output.

10. A method for controlling an ignition system, comprising:

controlling an igniter circuit adapted to couple to an ignition coil, the igniter circuit configured to:

count a first predetermined period with a first counter;

count with a second counter, wherein the second counter starts counting at a predetermined instance during the first predetermined period;

generate a reference current according to an output value of the second counter;

generate an output voltage according to the reference current and a coil current;

control an insulated-gate bipolar transistor according to the output voltage;

detect a decrease in the output voltage; and pause operation of the second counter when the decrease in the output voltage is detected.

11. The method according to claim 10, wherein generating the reference current comprises: generating a linearly decreasing reference current from a maximum value to a saturated value.

12. The method according to claim 11, wherein generating the reference current further comprises generating a linearly decreasing reference current from the saturated value to zero, wherein the reference current reaches zero no later than an end of the first predetermined period.

13. The method according to claim 10, further comprising resuming operation of the second counter when the first predetermined period ends.

14. An ignition system, comprising:

an ignition coil; and an igniter circuit coupled to the ignition coil and comprising an insulated-gate bipolar transistor (IGBT), wherein the igniter circuit is configured to:

generate a first count output for a first predetermined period;

generate a second count output;

generate a linearly decreasing reference current according to the second count output;

apply a gate voltage to the IGBT, wherein the gate voltage is based on the linearly decreasing reference current and an ignition coil current; and detect a decrease in the gate voltage.

15. The ignition system according to claim 14, wherein the igniter circuit starts to generate the second count output at a predetermined instance during the first predetermined period.

16. The ignition system according to claim 14 wherein the first predetermined period is independent of both a supply voltage level and a temperature of the ignition coil.

17. The ignition system according to claim 14, wherein the igniter circuit is further configured to:

pause the second count output when the gate voltage starts to decrease; and resume the second count output when the first predetermined period ends.

18. The ignition system according to claim 14, wherein a rate of change of the second count output is based on a clock frequency.

19. The ignition system according to claim 14, wherein an initial second count output corresponds to a reference current value that is greater than a saturation current of the IGBT.

* * * * *